US006290385B1

(12) United States Patent
Johansson

(10) Patent No.: US 6,290,385 B1
(45) Date of Patent: Sep. 18, 2001

(54) DEVICE FOR THE HOMOGENIZATION OF A LIQUID

(75) Inventor: Stig Johansson, Ronninge (SE)

(73) Assignee: Ecco Finishing AB, Skara (SE)

( * ) Notice: Subject to any disclaimer, the term of this patent is extended or adjusted under 35 U.S.C. 154(b) by 0 days.

(21) Appl. No.: 09/584,663

(22) Filed: Jun. 1, 2000

(30) Foreign Application Priority Data

Jun. 19, 1999 (SE) ..... 9902038

(51) Int. Cl.[7] ..... B01F 15/02
(52) U.S. Cl. ..... 366/137; 366/167.1; 366/191
(58) Field of Search ..... 366/136, 137, 366/131, 191, 167.1; 422/227, 231, 234; 137/590, 592; 220/86.1

(56) References Cited

U.S. PATENT DOCUMENTS 1,003,905 * 9/1911 Hill ..... 366/137
3,421,738 * 1/1969 Dulger ..... 366/167.1
4,347,004 * 8/1982 Platts ..... 366/137
4,744,959 * 5/1988 Punzar et al. ..... 366/167.1
5,083,686 * 1/1992 Cady et al. ..... 366/137
5,431,494 * 7/1995 Ishii et al. ..... 366/191

* cited by examiner

*Primary Examiner*—Tony G. Soohoo
(74) *Attorney, Agent, or Firm*—Young & Thompson

(57) ABSTRACT

A device for the homogenization of a liquid contained in a container comprises a pipe device possible to stick down in the container, said pipe device including an inner pipe (5') and an outer pipe (6'). A cup-like collar (15) with a bottom plate (16) and a circumfering flange (17) is mounted on the inner pipe. There are openings (18, 18') in the flange (17) which co-operate with analogous holes (19, 19') in the outer pipe (6'). When a hole (19') is adjusted in flush with an opening (18), the return liquid is ejected from a ring-shaped gap (9) in a radial jet. When a hole (19) is adjusted in a position distanced from an opening (18), the return liquid which passes the hole will meet the inside of the flange (17) and be deflected in a upwardly directed flow in the container. By setting the collar (15) in a suitable position, optimum homogenization of the liquid may be attained.

7 Claims, 2 Drawing Sheets

DEVICE FOR THE HOMOGENIZATION OF A LIQUID

TECHNICAL FIELD OF THE INVENTION

Figure 1:
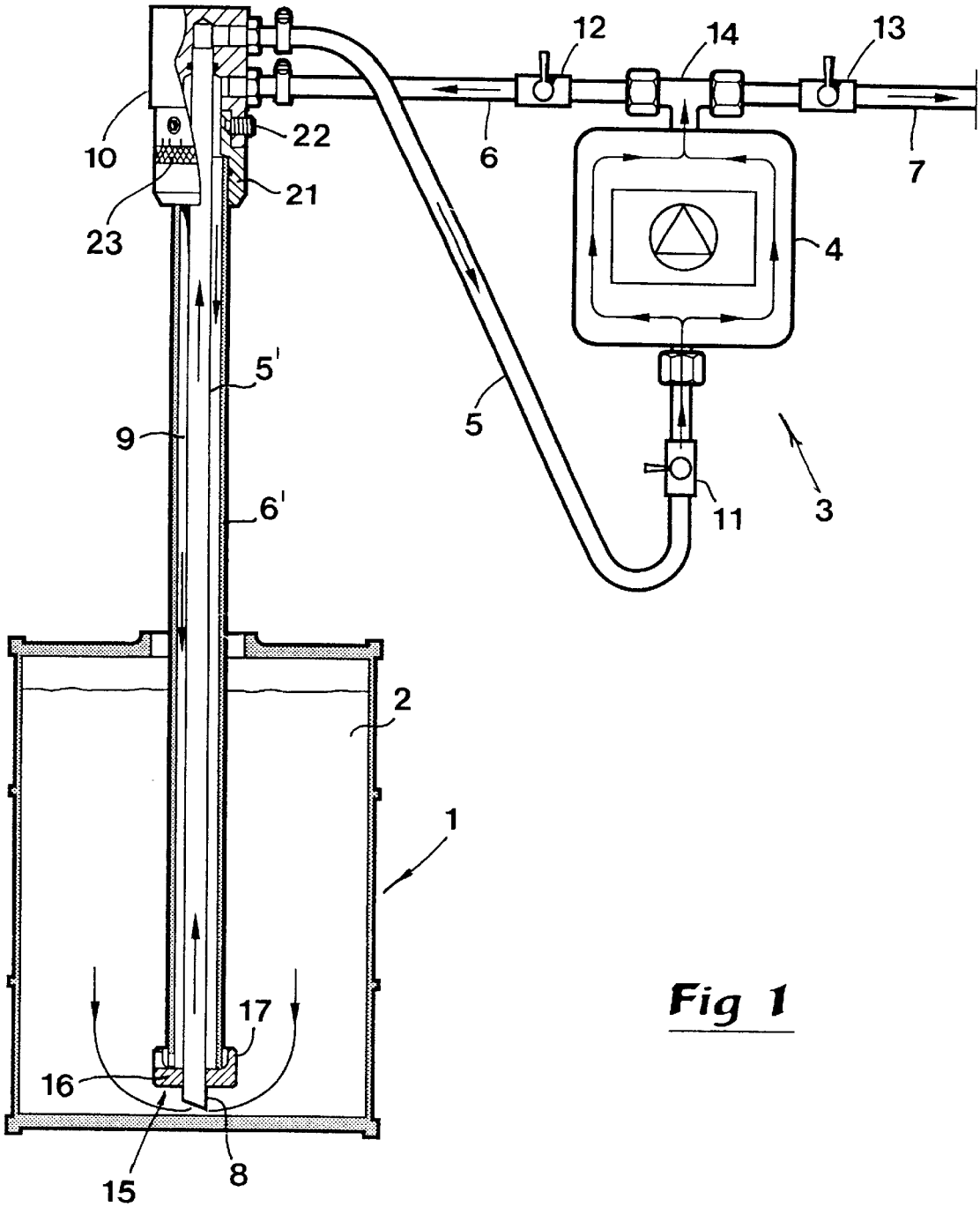

This invention relates to a device for the homogenization of a liquid which is stored in and may be drawn off a container, including a pump and three conduits connected thereto, a first one of which includes a first pipe possible to stick down vertically in the container, which pipe is arranged inside a coarser, second pipe included in the second conduit and protrudes with an end portion therefrom, a ring-shaped gap being provided between the outside of the first pipe and the inside of the second pipe, and the first conduit having the purpose of evacuating liquid from the container, the second conduit of returning liquid via said gap to the container for the purpose of homogenizing the liquid in the container, while the third conduit has the purpose of leading homogenized liquid to a tapping site, a distributing member being arranged on the projecting end portion of the first pipe.

PRIOR ART

Storage of liquids such as paints is, in practice, carried out in barrels, which may hold 200 litres. In such paints that contain pigments, the problem may arise, in particular after longer periods of storage, that the pigments sink to the bottom of the barrel. When the paint is to be used, e.g. in connection with spray painting or spray finishing, it is of vital importance that the paint is homogeneous, i.e. that the pigments and other component parts in the paint are completely and uniformly mixed with each other. Otherwise, the paint properties, such as colour, surface smoothness, coating properties, dripping tendency and the like, may deviate from what is desirable.

In order to homogenize paint before use, different techniques have previously been used, such as stirring by means of mechanical mixers, e.g. propeller mixers or helix mixers, which are stuck down into the barrel. Common for these techniques is, however, that they only bring about homogenization of the paint. This means that the subsequent discharge has to take place by means of a separate device, e.g. a pump with a suction pipe. In other words, two different devices have to be applied in the barrel. This handling gives rise to wastage and a generally smear working environment.

In order to overcome the above problem, a device of the initially mentioned type has been disclosed in SE 9701446-8, which can homogenize the paint and draw off the same without the need of removing the device from the storage container in question between these two operations. In this known device, on the free end portion of the paint or liquid evacuation pipe, a distributing member is arranged in the shape of a simple plate which extends perpendicularly to the pipe and may be adjusted on different levels in relation thereto. However, this distributing member has turned out to have a mediocre effect in respect of the ability thereof to distribute return liquid uniformly in the entire volume of the stored liquid. A special problem is based on the fact that the refill and drawing hole of conventional paint barrels has a limited diameter (approx. 80 mm), which means that a stiff distributing plate may be produced with only a very moderate, maximum diameter.

OBJECTS AND FEATURES OF THE INVENTION

The present invention aims at obviating the above-mentioned inconveniences of the homogenization device known from SE 9701446-8 and at providing an improved device. Therefore, a primary object of the invention is to provide a homogenization device the distributing member of which may distribute, in an effective way, arriving return liquid in the liquid volume positioned in the storage container in question. This should furthermore be able to take place in all essentials independently of the level for or the volume of the liquid quantity positioned in the container. Another object is to provide a device the distributing member of which can act effectively without having a large diameter.

According to the invention, at least the primary object is attained by the features defined in the characterizing clause of claim 1. Preferred embodiments of the invention are furthermore defined in the dependent claims.

BRIEF DESCRIPTION OF THE APPENDED DRAWINGS

Figure 2:
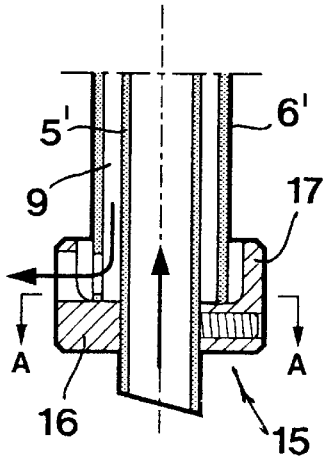
Figure 4:
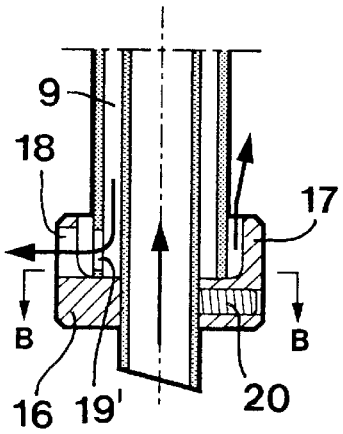
Figure 6:
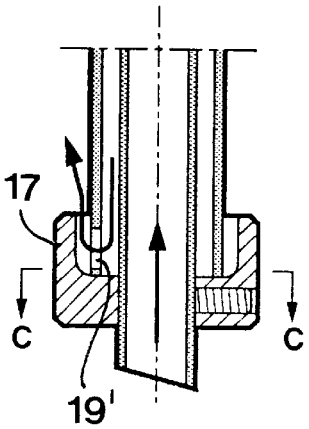
Figure 3:
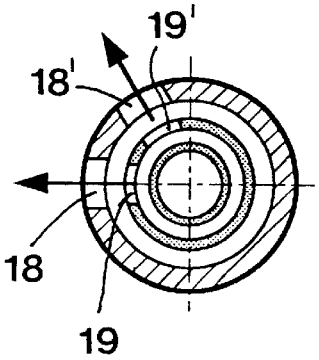
Figure 5:
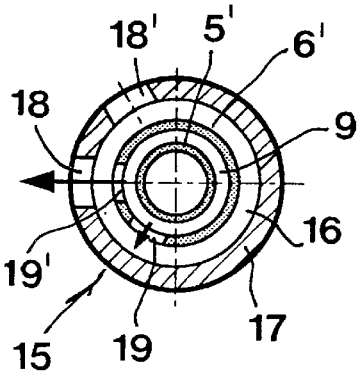
Figure 7:
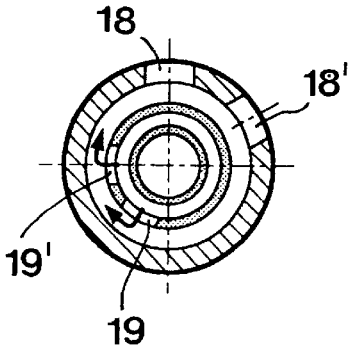

In the drawings:

FIG. 1 is a partly cut, partly schematic side view showing a device according to the invention adjacent to a schematically illustrated storage container for paint, FIG. 2 is a partial longitudinal section through a lower portion of a pipe device included in the device, a distributing member being shown in a first functional state, FIG. 3 is a cross-section A—A in FIG. 2, FIG. 4 is a longitudinal section corresponding to FIG. 2 showing the distributing member in a second functional state, FIG. 5 is a cross-section B—B in FIG. 4, FIG. 6 is a longitudinal section corresponding to FIG. 2 and 4 showing the distributing member in a third functional state, and FIG. 7 is a cross-section C—C in FIG. 6.

DETAILED DESCRIPTION OF A PREFERRED EMBODIMENT OF THE INVENTION

In FIG. 1 a container 1 is shown in the shape of a barrel for storage of paint or another liquid 2 as well as a device according to the present invention in its entirety designated 3. This device includes a pump 4 and three conduits 5, 6 and 7 connected thereto. The pump may in practice consist of a compressed-air driven double membrane pump, which may work continuously and stands no load operation. The first conduit 5 includes or is connected to a first, comparatively thin pipe 5' which suitably is of a form stiff character, while the second conduit 6 in an analogous way includes a second, suitably form stiff pipe 6' which has a larger diameter than the pipe 5'. The thinner pipe is arranged inside the coarser one with a lower end portion 8 protruding a distance from the coarser pipe, a ring-shaped gap 9 being formed between the outside of the inner pipe 5' and the inside of the outer pipe 6'. The pipes 5', 6' are built together to an integrated, continuous pipe device. More precisely, the upper ends of the pipes are connected to a common head 10.

In the conduits 5, 6, 7, valves 11, 12 and 13 are arranged, which advantageously may be of the type which can guarantee control of the magnitude of a passing liquid flow as well as complete cut-off of the flow. The two conduits 6 and 7 are inter-connected via a T-coupling 14 on the downstream side of the pump.

A distributing member generally designated 15 is arranged on the pipe's 5' end portion 8 projecting from the pipe 6'.

The shown device operates in the following way: When the liquid 2 in the container 1 only is to be homogenized, the valve 13 is kept closed. The pump 4 will then pump the liquid in a closed cycle. More precisely, liquid is sucked up from the bottom of the container via the inner pipe 5' and the connecting conduit 5 (which may consist of a hose), and then return liquid is pumped back to the container via the conduit and the ring gap 9 outwardly closed by the pipe 6'. After the liquid in the container 1 has been homogenized, the valve 12 may be shut, and the valve 13 being opened in order to draw off liquid, at continued pumping, to a desired, not shown tapping point, e.g. in a spray gun. By setting the valves 12, 13 in suitable, only partly open positions, it is also feasible to continuously homogenize the liquid in the container at the same time as a certain quantity is drawn off via the outgoing output conduit 7.

As far as the shown device has been described hitherto, the same is in all essentials previously known by SE 9701446-8.

New and characteristic for the present invention is the special distributing member 15, which is applied on the pipe device stuck down in the container 1. According to the invention, this members consists of a cup-shaped collar including a bottom plate 16 and a circumfering flange 17, which is directed upwards from the bottom plate 16. In the example according to FIGS. 2–7, there are two openings 18, 18' in said flange 17, which may be in the form of radial holes in the flange. These openings 18, 18' co-operate with a pair of holes 19, 19' in the outer pipe 6'. The arc angle between imaginary, radial centre lines through the holes 19, 19' is equally large as the arc angle between imaginary centre lines of the openings 18, 18'. In the example, this arc angle attains approx. 45°, although also other arbitrary angles are feasible, e.g. 90°.

As may be seen in FIG. 4, each opening 18, 18' in the flange 17 is arranged in the immediate vicinity of the top side of the bottom plate 16, and the holes 19, 19' being provided in the immediate proximity to the lower end of the pipe 6'.

The collar 15 and the second pipe 6' are turnable in relation to each other in order to enable adjustment of the holes 19, 19' in different, operative positions in relation to the flange 17 and the openings 18, 18' therein. In a first position, the individual hole 19, 19' may be adjusted in radial flush with each one of the two openings 18, 18' in the flange 17, as is shown in FIGS. 2 and 3. In the position according to FIGS. 4 and 5, only one of the holes 19' is in radial flush with an opening, viz. the opening 18, while the second hole 19 faces the inside of the flange 17. In FIGS. 6 and 7, a third setting is shown in which the two holes 19, 19' are distanced from the openings 18, 18' and face the inside of the flange.

In the first setting according to FIGS. 2 and 3, return liquid which is pumped back via the ring gap 9 will be ejected in two radial jets, viz. via the pair of holes and openings 19, 18 and 19', 18', respectively, which are in flush with each other. In the second setting according to FIGS. 4 and 5, one jet will still be ejected radially, viz. via the hole 19' and the opening 18. However, the liquid, which is ejected via the hole 19, will meet the inside of the flange 17 and be deflected in a substantially axial, upwardly directed jet or an upwardly directed flow. In the third setting according to FIGS. 6 and 7, the liquid which passes through the holes 19, 19' will meet the flange and be deflected in two substantially axial, upwardly directed part flows. Thus, there are no radial jets here.

In the exemplified embodiment, the turnability between the collar 15 and the outer pipe 6' is realized by the fact that the two pipes are turnable in relation to each other at the same time as the collar is fixed on the outside of the inner pipe 5', e.g. by means of a locking screw 20. The inner pipe 5' is fixed in the aforementioned head 10, while the outer pipe 6' is connected to a cage 21 which is turnable in relation to the head in a suitable way and possible to fix in different desired settings, e.g. by means of one or more locking screws 22. On the outside of the cage 21, there may be a scale 23 or other suitable markings, which show the angle of rotation in question between the outer pipe 6' and the collar 15.

In the above-mentioned embodiment, adjustment of the angle of rotation may take place during operation, i.e. with the pipe device stuck down in the storage container. However, it is also feasible to form the device with the two pipes 5', 6' fixed relative to each other at the same time as the collar 15 is turnable and possible to fix in relation to the inner pipe 5'.

In other respects, it should be noted that the collar 15 is located in the immediate vicinity of the lower, free end of the inner pipe 5. This means that the return liquid is distributed out in the existing liquid 2 in a point situated near the bottom of the container. In that manner, an optimum mixing effect is attained because the return liquid jets are ejected in the part of the liquid where, for instance, pigment is accumulated. It should also be pointed out here that during a homogenization operation the pipe device composed of the pipes 5' and 6' may be turned in relation to the container in order to orientate a radial jet in different directions in the container.

In FIGS. 2, 4 and 6 is furthermore seen that the free, lower end of the inner pipe 5' advantageously is obliquely cut. This means that liquid intake in the pipe is guaranteed also if the pipe is put down at the bottom of the container.

In practice, the outer diameter of the flange 17 of the collar should be not more than 50% larger than the outer diameter of the pipe 6'. In other words, in that manner the collar gets a very limited diameter in relation to the diameter of the outer pipe, whereby the collar without any problem may be brought down through existing refill and discharge hole in the container, also if this hole has a minimal width.

FEASIBLE MODIFICATIONS OF THE INVENTION

The invention is not solely restricted to the embodiment described above and shown in the drawings. Thus, the number of holes and openings in the outer pipe and the flange of the collar, respectively, may deviate from two. Thus, in a simple version of the device, only one hole in the outer pipe and one opening in the flange of the collar may be included. The number of holes and openings, respectively, may also be more than two. Furthermore, it is feasible to locate the holes and openings, respectively, on different levels in order to direct the radial jets either obliquely downwards or obliquely upwards instead of horizontally, as has been exemplified in the drawings.

What is claimed is:

1. Device for the homogenization of a liquid (2) which is stored in and may be drawn off a container (1), including a pump (4) and three conduits (5, 6, 7) connected thereto, a first one (5) of which includes a first pipe (5') possible to stick down vertically in the container (1), which pipe is arranged inside a coarser, second pipe (6') included in the second conduit (6) and protrudes with an end portion (8) therefrom, a ring-shaped gap (9) being provided between the outside of the first pipe (5') and the inside of the second pipe (6'), and the first conduit (5) having the purpose of evacuating liquid from the container, the second conduit (6) of returning liquid via said gap (9) to the container with the purpose of homogenizing the liquid in the container, while the third conduit (7) has the purpose of leading homogenized liquid to a tapping site, a distributing member (15) being arranged on the projecting end portion (8) of the first pipe (5'), characterized in that the distributing member consists of a cup-like collar (15) including a bottom plate (16) and a circumfering flange (17) directed upwards therefrom in the mounted state of the device, in which flange there is at least one opening (18) for co-operation with at least one hole (19) in the second pipe (6'), the collar (15) and the second pipe (6') being mutually turnable in order to set said hole (19) either in a first position in radial flush with the opening (18) to eject return liquid from said ring gap (9) in a radial jet, or in a second position in which the liquid from the hole (19) ejects against the inside of the flange (17) and is deflected in a substantially axial, upwardly directed jet.

2. Device according to claim 1, characterized in that two or more tangentially spaced openings (18, 18') are provided in said flange (17) and that two or more tangentially spaced holes (19, 19') are provided in the second pipe (6') to enable simultaneous ejection of two or more liquid jets, which separately may be either axially or radially directed.

3. Device according to claim 1, characterized in that the collar (15) is permanently located in the immediate vicinity of the free end of the first pipe (5').

4. Device according to claim 1, characterized in that said holes (19, 19') are located in the immediate vicinity of the free end of the second pipe (6').

5. Device according to claim 1, characterized in that the collar (15) is rigidly connected to the first pipe (5') and that the two pipes (5', 6') are turnable in relation to each other.

6. Device according to claim 1, characterized in that the free end of the first pipe (5') is obliquely cut.

7. Device according to claim 1, characterized in that the flange (17) of the collar (15) has an outer diameter which is no more than 50% larger than the outer diameter of the second pipe (6').

* * * * *